US005832535A

United States Patent [19]

Davis

[11] Patent Number: 5,832,535

[45] Date of Patent: Nov. 10, 1998

[54] GENITAL COVERING GARMENT

[76] Inventor: Carol L. Davis, 330 Allen Rd., Gurley, Ala. 35748

[21] Appl. No.: 928,004

[22] Filed: Sep. 11, 1997

[51] Int. Cl.[6] ..... F41D 5/00

[52] U.S. Cl. ..... 2/1; 2/67; 2/69; 2/400; 2/408

[58] Field of Search ..... 2/1, 400–408, 2/228, 238, 67, 69

[56] References Cited

U.S. PATENT DOCUMENTS

| | | | |
|---|---|---|---|
| 3,339,208 | 9/1967 | Marbach | 2/406 |
| 4,905,323 | 3/1990 | Lampman | 2/406 |
| 5,347,657 | 9/1994 | Unsell | 2/406 |
| 5,367,715 | 11/1994 | Leonard et al. | 2/403 |
| 5,368,050 | 11/1994 | Donelan | 2/406 |
| 5,396,662 | 3/1995 | Leonard et al. | 2/403 |
| 5,467,482 | 11/1995 | Crawford, II | 2/406 |

*Primary Examiner*—Gloria M. Hale
*Attorney, Agent, or Firm*—John C. Garvin, Jr.

[57] ABSTRACT

A genital covering for covering only one's genitals while that person is undergoing examination and preparation for surgery, during the actual surgical procedure, and additionally while one is undergoing tanning on a tanning bed. The covering includes a front body section which is releasably adhered to the abdomen of the person and a lower elongated section which extends through the person's legs and is provided with a distal end which is releasably attached to the back of the person, in an area which is generally above the buttock area. While covering only the genitals, the person's abdomen, thighs and buttocks are left completely exposed.

9 Claims, 2 Drawing Sheets

GENITAL COVERING GARMENT

FIELD OF THE INVENTION

This invention relates to genital coverings for covering the genitals of a person while leaving the abdomen, thighs and buttock areas of the person substantially completely exposed.

BACKGROUND OF THE INVENTION

While undergoing a medical examination, and/or operation on one's body, particularly the buttock, thighs and abdominal areas of the body, but not the genitals, per se, one typically prefers to have the genitals covered and not available to be scrutinized by the examining doctor, or in particular, the doctor's staff or assistants. However, such medical examination and/or operation procedures often require substantially complete exposure of the person's abdomen, thighs, and/or buttocks, providing a problem in exposing as much as the abdomen, thighs and buttocks as possibly to the attending personnel while also preventing exposure of the genitals.

This problem manifests itself when one is considering liposuction surgery. In examining and preparing one for the liposuction procedure the patients' abdomen and thighs and buttock areas must be substantially completely exposed so that the physician may draw lines and otherwise mark those portions that require attention during the liposuction surgery, however, the patient typically prefers that the genital area remain unexposed, during the examination and preparation for surgery. Also, typically, the patient prefers that the genitals are covered during the surgical procedure, per se.

The genital covering of the present invention is also very useful as a covering when one is using a tanning bed and wishes that he or she may receive a tan over as much of the body as possible while also receiving a certain amount of privacy. Additionally, the covering affords a high degree of protection of the genitals from UV radiation from the lamps of the tanning bed.

It is, therefore, an object of the present invention to provide a genital covering which provides substantially complete exposure of the abdomen, thighs and buttocks areas of a person while also providing substantially complete coverage of the genitals of the person.

It is another object of the present invention to provide such a genital covering which may rapidly and in a facile manner be removably adhered to the person's body.

DESCRIPTION OF THE PREFERRED EMBODIMENTS

Figure 1:
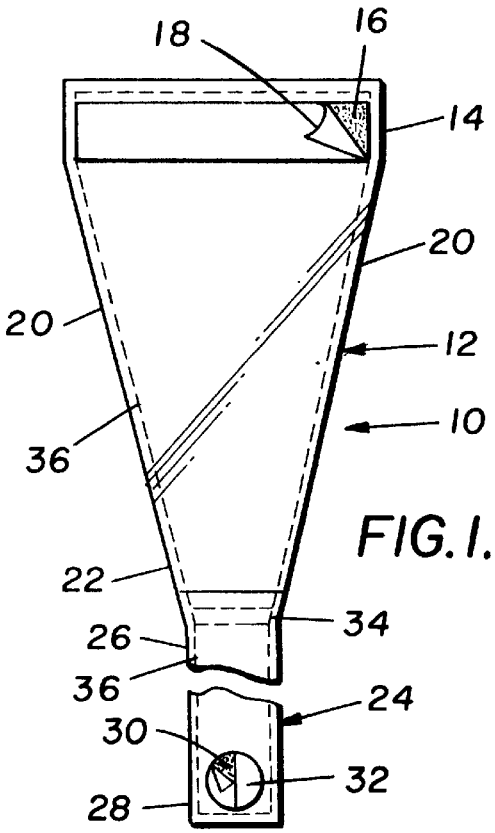
FIG. 1 is a plan view of the genital covering of the present invention. The genital covering is shown to include a substantially triangular section having an elongated strip extending from the lower truncated corner of the triangle. Adhesive coverings are shown which cover an adhesive strip disposed along the upper horizontally extending edge of the triangular section and the distal end of the elongated strip.

As seen in FIG. 1 a genital covering 10 is shown to include a substantially triangular front section 12 having a substantially horizontal rectangular portion at the upper end 14 thereof. Upper end 14 is shown to be provided with an adhesive 16 thereon and a removable protective covering or strip 18 is shown on the adhesive. Protective strip 18 is utilized when covering 10 is not in use or in storage. Tapered side edges 20 extend from the horizontal rectangular section to a lower end of triangular section 12 to form a truncated end portion 22.

Covering 10 further includes a lower straight elongated strip section 24 attached to, as by stitching 34, and extending from truncated end portion 22. The area at the juncture of truncated end portion 22 and elongated strip section 24 form an intermediate section which is positioned between the legs of the person. Section 24 includes an upper end portion 26 and a lower end portion 28. Upper end portion 26 is secured to the truncated end 22 of triangular section 12, as discussed supra, and lower end portion 28 has an adhesive 30 disposed thereon. A protective adhesive strip 32 is provided on adhesive 30 when covering 10 is not being used or is in storage. The genital garment is, as illustrated in the figures, of a fabric material and the borders or edges of both the triangular and strip sections 12 and 24 may be provided with stitching 36 thereon to bind the edges and prevent fraying thereof.

Figure 2:
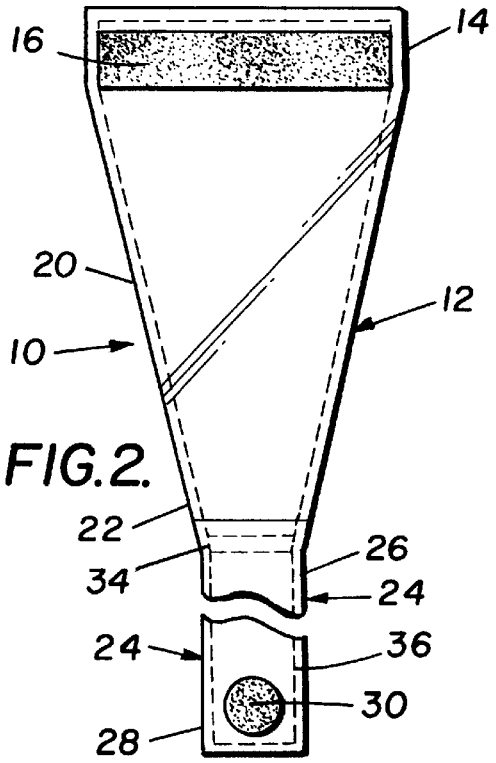
FIG. 2 is a plan view of the genital covering of FIG. 1 with the adhesive covering removed.

FIG. 2 is a plan view of the covering of FIG. 1 and illustrates the adhesive covering 32 as being removed to expose the adhesive 30.

Figure 3:
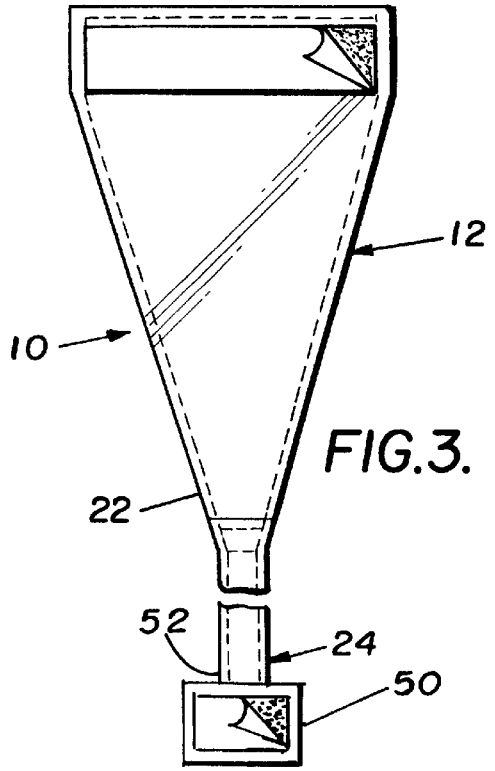
FIG. 3 is a plan view of the genital covering of FIG. 1 showing the extending elongated strip to be narrower than that shown in FIG. 1 while also providing an enlarged adhesive area at the distal end of the elongated strip.
Figure 4:
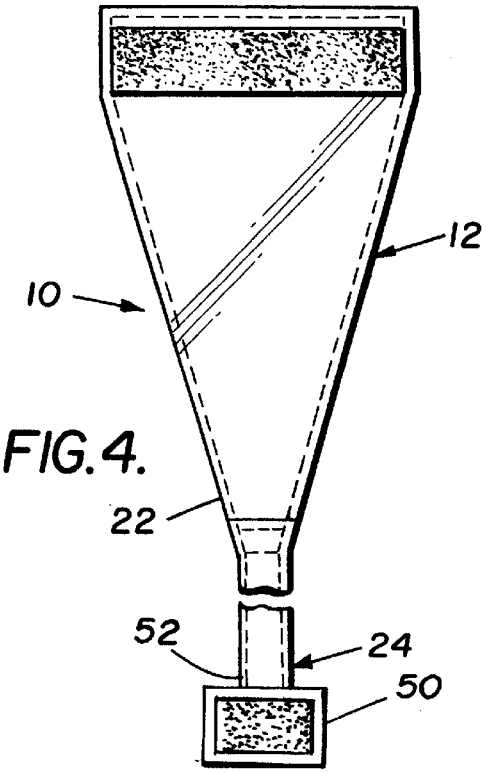
FIG. 4 is a plan view similar to FIG. 3 with the adhesive covering removed.

FIGS. 3 and 4 are plan views of a covering similar to that shown in FIG. 1 with like numerals referring to like parts. The difference between the embodiments of FIGS. 3 and 4 relative to FIGS. 1 and 2 is that the lower strip 24 is narrower than that shown in FIGS. 1 and 2 and, also, an enlarged section 50 is attached to the distal end 52 (as by stitching, etc.) of the strip 24 to provide a larger area of adhesive 30 so as to more securely adhere the strip 24 to the person's back as described hereinbelow.

Figure 5:
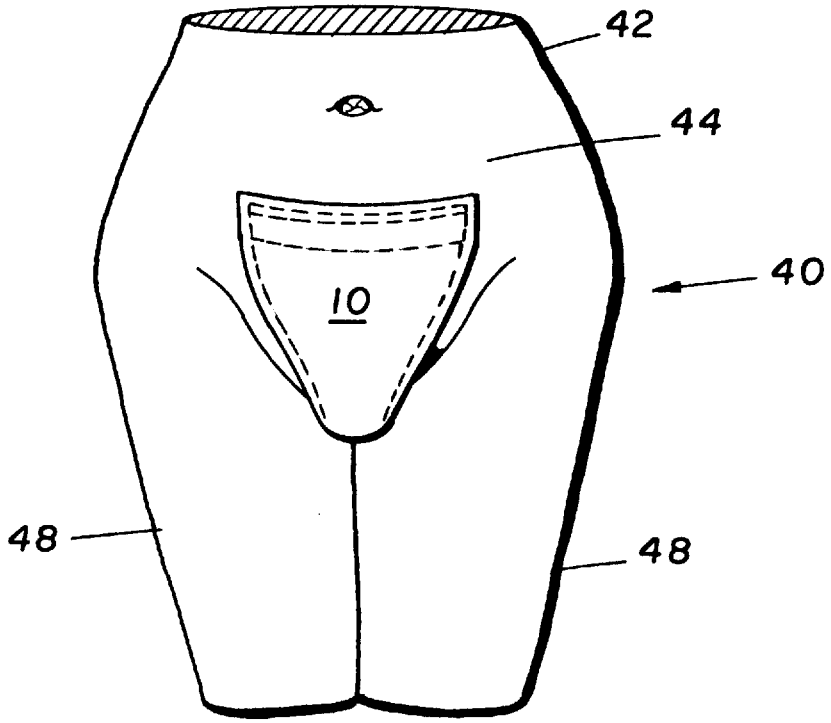
FIG. 5 is a pictorial view of the abdominal portion of a person having the covering of the present invention worn thereon.

FIG. 5 is a pictorial view of the abdominal portion of a person's body having the covering of the present invention shown in FIGS. 1 and 2 in position over the person's genitals. As seen in FIG. 5, triangular portion 12 of covering 10 is shown to be covering only the genital area of the person, thus leaving the waist 42, belly 44, and thighs 48 of the person's body exposed.

Figure 6:
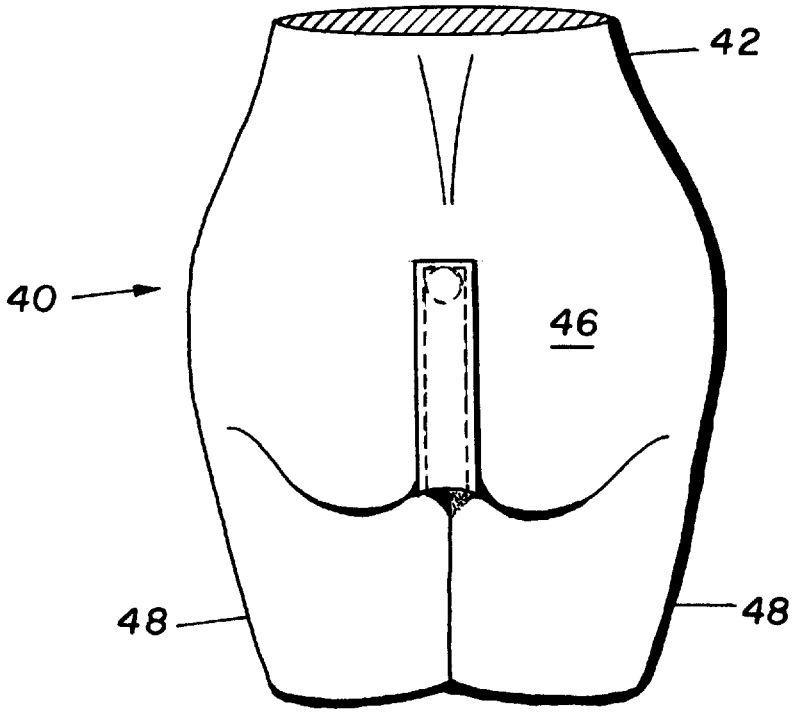
FIG. 6 is a pictorial view of the rear of a person wearing the garment of the present invention.

FIG. 6 is a pictorial view of the rear of a person wearing the covering 10. As seen in FIG. 6, the lower strip 24 extends from between the person's legs to a position above the buttocks and adjacent the spine where end portion 28 is secured by adhesive 30. The covering shown in FIGS. 3 and 4 is secured to the person's back, however, the enlarged area of adhesive enhances the adhering effect of the lower rectangular portion to the person's back. Although enlarged section 50 is shown to be rectangular this is for illustrative purposes only and it is to be understood that enlarged section 50 may be circular, triangular, etc.

It is to be understood that the elongated strip 24 of the garment (as clearly illustrated in the figures) may be a narrow rectangular strip which extends through the persons legs and up the back in the crease between the buttocks to completely expose the buttocks of the person wearing the flexible garment.

While specific embodiments of the invention in genital coverings have been described in detail herein, it will be realized that wide variations can be resorted to that is within the spirit and scope of the appended claims.

I claim:

1. A garment for covering the genital area of a person comprising:

a body having a section configured to cover only the genitals of a person while leaving the abdomen, thighs and buttocks areas of the person completely exposed, said body including a front section having an upper horizontally extending surface, said body disposed for covering the pubic area of the person, and further including an intermediate section for extending through the legs of the person, and a back section extending away from said intermediate section, said back section having a distal end and being configured in the form of a straight elongated strip for extending upwardly in the crease between the buttocks of the person to leave the buttocks completely exposed; and first and second adhering means for releasably adhering said body to said person, said first adhering means disposed on said upper surface and said second adhering means disposed on said distal end.

2. A genital covering as in claim 1 wherein said front section is substantially triangular in configuration.

3. A genital covering as in claim 2 wherein said triangular section includes an upper horizontally extending substantially rectangular portion and a lower truncated portion having said elongated strip extending therefrom.

4. A genital covering as in claim 3 wherein said first means for releasably adhering said covering to said person is a first adhesive surface provided on said upper horizontally extending substantially rectangular portion.

5. A genital covering as in claim 4 wherein said second means for releasably adhering said covering to said person is a second adhesive disposed on the distal end of said extending elongated strip.

6. A genital covering as in claim 5 wherein said strip is provided with a substantially rectangular configuration.

7. A genital covering as in claim 6 wherein said distal end of said strip is enlarged relative to the width of said strip to provide a larger adhering area than that afforded only by the width of said rectangular strip.

8. A garment for covering the genital area of a person comprising:

a body having a section configured to cover only the genitals of a person while leaving the abdomen, thighs and buttocks completely exposed, said body having a front triangular section provided with an adhesive means for releasably securing said triangular section to the abdomen of the person and an elongated rectangular strip section for extending from said triangular section and through the legs and up the crease of the buttocks of the person to leave the buttocks completely exposed; and said elongated rectangular strip section having a distal end provided with an adhesive means thereon for adhering said distal end to the back of the person.

9. A genital covering as set forth in claim 1 wherein said elongated strip is provided with a rectangular configuration.

* * * * *